US006524409B2

(12) United States Patent
Barone et al.

(10) Patent No.: US 6,524,409 B2
(45) Date of Patent: Feb. 25, 2003

(54) METHOD FOR HOT ISOSTATIC PRESSING AND HEAT TREATMENT OF LIGHT ALLOY CASTINGS

(75) Inventors: Stefano Barone, Turin (IT); Sergio Gallo, Turin (IT); Claudio Mus, Aosta (IT)

(73) Assignee: Teksid Aluminum S.p.A., Carmagnola (IT)

( * ) Notice: Subject to any disclaimer, the term of this patent is extended or adjusted under 35 U.S.C. 154(b) by 0 days.

(21) Appl. No.: 09/782,034

(22) Filed: Feb. 14, 2001

(65) Prior Publication Data

US 2001/0023722 A1 Sep. 27, 2001

(30) Foreign Application Priority Data

Feb. 14, 2000 (IT) ..... TO00A0138

(51) Int. Cl.[7] ..... C22F 1/04; C22C 21/00

(52) U.S. Cl. ..... 148/549; 148/437; 148/698

(58) Field of Search ..... 148/544, 698, 148/437

(56) References Cited

U.S. PATENT DOCUMENTS 5,284,620 A * 2/1994 Larsen, Jr. ..... 148/421
6,146,477 A * 11/2000 Clark et al. ..... 148/539

* cited by examiner

*Primary Examiner*—Roy King
*Assistant Examiner*—Andrew Wessman
(74) *Attorney, Agent, or Firm*—Sughrue Mion, PLLC

(57) ABSTRACT

A method of producing light alloy castings by foundry technology in which, after solidification and shake-out, the casting is subjected to a heat-treatment cycle comprising a solution heat-treatment step at a temperature high enough to put into solution the phases precipitated in the course of the solidification of the casting, possibly followed by a quenching step and an ageing step, wherein the solution heat-treatment step is performed at least partially in hot isostatic pressing conditions.

7 Claims, 1 Drawing Sheet

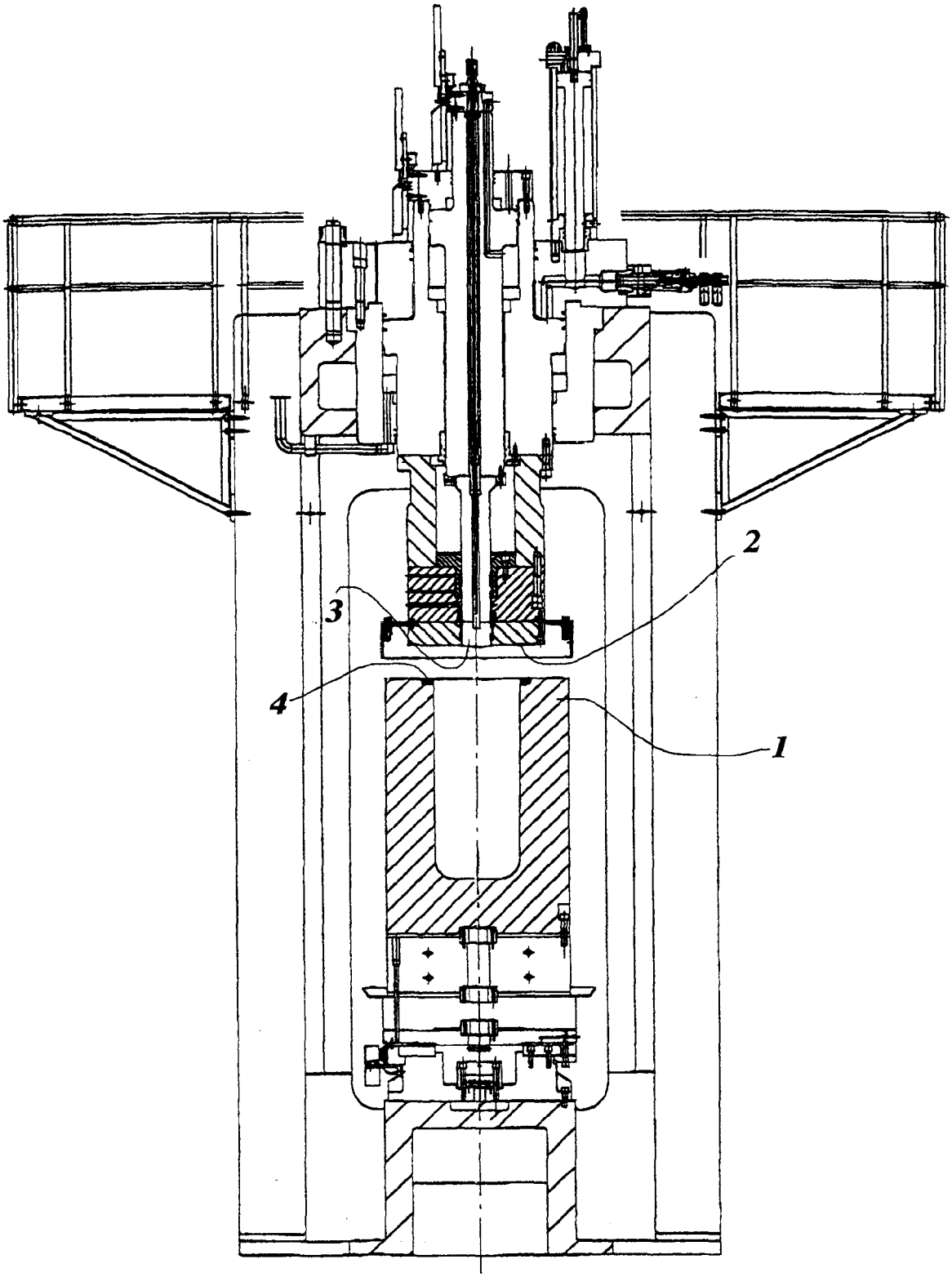
2
3
4
1

METHOD FOR HOT ISOSTATIC PRESSING AND HEAT TREATMENT OF LIGHT ALLOY CASTINGS

BACKGROUND OF THE INVENTION

The present invention relates to a method of producing light alloy castings by means of foundry technology.

The cycle for the manufacture of light alloy castings with the use of foundry technology generally provides for a heat-treatment cycle, after solidification and shake-out, to confer on the material the mechanical characteristics required for its use.

For example, for aluminium alloy components, the heat-treatment cycle generally consists of a solution heat-treatment step having a duration of about 6–10 hours, followed by quenching and ageing with a duration of about 4–6 hours.

The objects of the various steps of the cycle can be sunmmarized as follows:

1. the solution heat-treatment step is carried out at high temperature in order to fully utilize diffusion phenomena and in order to homogenize the chemical composition of the material and to put into solution the phases precipitated in the course of the solidification of the casting;
2. the quenching step consists of controlled, generally rapid cooling from the solution temperature to a temperature close to ambient temperature so as to prevent the uncontrolled formation of new precipitates;
3. the ageing step consists in heating to an intermediate temperature and maintenance of this temperature for sufficient time to bring about controlled precipitation of the hardening phases.

Within the field of foundry-casting treatment methods, the hot isostatic pressing (HIP) method -is also known and constitutes a technique which is widely used for the treatment of castings having internal porosity, in order to eliminate the porosity and to compact the casting. In particular, the HIP method consists of the subjection of the casting to high temperature and high pressure, for example, by pressure of an inert gas such as argon, for a period of time suitable to achieve a metallurgical structure possibly free of internal porosity. This method, which involves a substantial burden in terms of production and plant costs, is therefore generally used for reclaiming defective castings. Sometimes, the hot isostatic pressing step is also inserted in the heat-treatment cycle between the solution heat-treatment step and the quenching to eliminate or at least drastically reduce the porosity of the casting and thus reduce rejects.

The implementation of the complete cycle for the heat treatment of the casting as described above undoubtedly leads to a considerable increase in costs, depending on the duration of the heat-treatment steps and, in particular, of the solution heat-treatment step which, since it is connected with diffusion phenomena, requires the treatment furnace to be used for long periods.

SUMMARY OF THE INVENTION

The object of the present invention is to reduce the times required for the heat-treatment of light alloy castings and also to improve the mechanical characteristics of the material so as to produce castings having better performance than conventional castings.

In particular, the method of the invention results from the discovery of the fact that, when the hot isostatic pressing process is performed at a temperature close to the solution temperature of the casting, it can achieve at least partial solution of the phases precipitated in the casting so that this process is of assistance in the solution heat treatment itself.

The subject of the invention is therefore a method of producing light alloy castings by foundry technology in which, after solidification and shake-out, the -casting is subjected to a heat-treatment cycle comprising a solution heat-treatment step at a temperature high enough to put into solution the phases precipitated in the course of the solidification of the casting, possibly followed by a quenching step and an ageing step, characterized in that the solution heat-treatment step is performed at least partially in hot isostatic pressing conditions. The solution heat-treatment step is preferably carried out with the casting kept at the solution temperature, at substantially atmospheric pressure, for a period of time long enough to bring about only partial solution of the precipitated phases, after which the casting, which is kept at a temperature at least equal to the solution temperature, is subjected to hot isostatic pressing until the solution of the precipitated phases is complete.

In particular, the method according to the invention substantially reduces the times required for the solution heat-treatment step by virtue of the fact that at least a portion of the solution heat-treatment process is performed at very high pressure in a hot isostatic press.

The high-pressure solution heat treatment can be performed in plants in which the pressure is supplied by a fluid (liquid or gas) which acts on the casting directly or by means of an intermediary, and accelerates the diffusion phenomena, consequently reducing cycle times. It is particularly preferable for the hot isostatic pressing process to be carried out by means of isostatic pressure exerted by a liquid as described in EP-A-603 482, the description of which is intended to be incorporated in the present description by reference. The method described therein involves the compaction of a casting by process steps in which the casting is first placed in a first bath of fused salts which act as a medium for the transmission of pressure inside a container; this pressure-transmission medium is heated to a compaction temperature; the container in turn is placed in a second pressure-transmission medium at a second temperature, lower than the first temperature, and the first and second media are put into communication so that a pressure applied to the second medium is transmitted to the first medium. A pressure sufficient to compact the casting is then applied to the second medium at the lower temperature.

Within the scope of the present invention and, in particular, during the treatment of light alloys of nonreactive metals, it suffices to place the casting in a first container containing a bath of fused salts and to apply the necessary pressure to the bath directly.

The method according to the invention is applicable, in particular, to light alloy castings constituted by alloys of aluminium and magnesium such as in particular: Al—Mg—Si, Al—Cu, Mg—Al—zn, Mg—Al—Mn and Ti—Al alloys.

The solution temperature, with reference to aluminium and magnesium alloys, expressed in degrees centigrade, is typically about 65–80% of the fusion temperature, typically between 470° C. and 540° C., according to the alloy.

As stated, the first part of the solution heat-treatment process is carried out at the above-mentioned temperature, without pressure, until partial solution of the precipitated phases is achieved; a suitable partial solution heat-treatment can be quantified as that which achieves solution equal to about 40–80% by weight, preferably at least 50% of the total weight of the phases precipitated in the course of the solidification of the casting. The time required to achieve a corresponding solution can easily be determined by a person skilled in the art by a few experimental tests and with the aid of microstructural analysis.

The solution heat treatment is then completed by HIP, preferably in a bath of fused salts, at pressures within the range of from 700 to 1200 bars. The time required for the isostatic pressing in the fused bath can advantageously be reduced to less than one minute and is typically between 20 and 40 seconds.

Thus, for example, in the case of the heat treatment of an aluminium alloy for which, according to the conventional process, solution heat-treatment times of the order of about 8 hours are typically used, the solution heat-treatment time can be reduced to about 4–5 hours by the method according to the invention.

The method according to the invention also achieves not only a reduction in the porosity and in solidification defects in general, which are typical results of high-pressure treatment, but also achieves a substantial reduction in treatment times and improves the mechanical characteristics of the material to limits higher than those which can be achieved with conventional treatment and, above all, reduces the scatter band of the mechanical characteristics, thus achieving better performance.

Further characteristics and advantages of the method according to the invention will become clear from the following non-limiting example.

BRIEF DESCRIPTION OF THE DRAWING

The appended drawing is a partially-sectioned, schematic view which shows isostatic pressing apparatus for implementing the method in accordance with the example.

DETAILED DESCRIPTION OF THE INVENTION

EXAMPLE

The example relates to the preparation of a 356 aluminium alloy casting.

After being removed from the mould, the castings were inserted in a metal mesh basket which in turn was transferred into a preheating furnace where it was kept at the solution heat-treatment temperature appropriate for the material, typically from 470° C. to 540° C., preferably 530° C., for a period of about 4 hours. When the ideal temperature was reached, the basket was removed from the preheating furnace and inserted in a container of an isostatic pressing apparatus such as that shown schematically in the appended drawing.

In the drawing, the isostatic pressing apparatus comprises a container 1 for holding a bath of fused salts, a cover 2 which closes the container in a leaktight manner with the aid of a seal 4 made of ductile material which is compressed and deformed. A piston 3, associated with the cover, can slide sealingly and can move forward into the bath of fused salts contained in the basket (not shown) so as to reduce the volume of the salt. The device enables pressures greater than 1200 atmospheres to be reached.

The container 1, already filled with a bath of fused salts, received the basket containing the castings to be treated and the bath of fused salts acted as a medium for the application of the pressure to the castings. After the container had been sealed and the air had been removed so that the bath of fused salts completely filled the space available inside the closed container, the piston was moved forward into the bath, generating pressure; the pressure was maintained for the time necessary to perform the treatment, typically for a period of from 15 to 40 seconds; the pressure was then released, the container was opened, and the basket could be removed quickly for transfer to the quenching step.

The reduction in the solution heat-treatment times results from the fact that the considerable pressure applied to the casting increases the rate of diffusion of the alloy elements. A shorter time therefore suffices to achieve the same solution result if the alloy is subjected to pressures much higher than atmospheric pressure. Naturally, the process parameters and the details of construction may be varied widely with respect to those specifically described.

What is claimed is:

1. A method of producing light alloy castings by foundry technology in which, after solidification and shake-out, the casting is subjected to a heat-treatment cycle comprising a solution heat-treatment step at a temperature high enough to put into solution the phases precipitated in the course of the solidification of the casting, followed by a quenching step and an ageing step, wherein the solution heat-treatment step is performed at least partially in hot isostatic pressing conditions and wherein the solution heat-treatment step is carried out with the casting kept at the solution temperature, at substantially atmospheric pressure, for a time long enough to bring about only partial solution of the precipitated phases, after which, the casting is kept at a temperature at least equal to the solution temperature and is subjected to isostatic pressing until the solution of the precipitated phases is complete.

2. A method according to claim 1, wherein the solution heat-treatment step at substantially atmospheric pressure is carried out for a time long enough to bring about solution equal to 40–80% by weight relative to the total weight of the precipitated phases present in the casting.

3. A method according to claim 1, wherein the solution heat-treatment step at substantially atmospheric pressure is carried out for a period no longer than 5 hours.

4. A method according to claim 1 in which the solution heat-treatment step in the hot isostatic pressing conditions is carried out for a period of between 15 and 40 seconds at a pressure of between 700 and 1200 bar, with the use of a liquid pressure-transfer medium.

5. A method according to claim 4 in which the hot isostatic pressing is carried out by placing the casting in a container which is capable of holding a bith of fused salt, removing the air from the sealed container os tha tthe bath of salts completely fills the space inside the container, and exerting the necessary pressure on the bath by means of a piston which penetrates the bath.

6. A method according to claim 2 in which the casting to be treated is a casting formed by an alloy based on aluminium or magnesium, and the solution temperature is betwooen 470 and 540° C.

7. A method according to claim 6 in which the casing to be treated is formed from one alloy selected from the group consisting of Al—Mg—Si, Al—Cu, Mg—Al—Zn,Mg—Al—Mn and Ti—Al alloy.

* * * * *

UNITED STATES PATENT AND TRADEMARK OFFICE

CERTIFICATE OF CORRECTION

PATENT NO. : 6,524,409 B2 
DATED : February 25, 2003
INVENTOR(S) : Stefano Barone, Sergio Gallo and Claudio Mus It is certified that error appears in the above-identified patent and that said Letters Patent is hereby corrected as shown below:

Title page,
Item [73], Assignee, delete "TEKSID ALUMINUM S.p.A., Carmagnola (IT)"
insert -- TEKSID ALUMINIUM S.p.A., Carmagnola (IT) --.

Signed and Sealed this

Twenty-second Day of June, 2004

JON W. DUDAS
*Acting Director of the United States Patent and Trademark Office*